US009089745B2

(12) United States Patent
Greaney et al.

(10) Patent No.: US 9,089,745 B2
(45) Date of Patent: Jul. 28, 2015

(54) PLASMA TREATMENT OF GOLF CLUB COMPONENTS AND BONDING THEREOF

(75) Inventors: Mark Vincent Greaney, Vista, CA (US); Sanjay Mukatira Kuttappa, Oceanside, CA (US); Herbert Stanley Heffernan, III, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 502 days.

(21) Appl. No.: 13/335,532

(22) Filed: Dec. 22, 2011

(65) Prior Publication Data

US 2012/0165116 A1 Jun. 28, 2012

Related U.S. Application Data

(60) Provisional application No. 61/426,995, filed on Dec. 23, 2010.

(51) Int. Cl.
*B32B 37/02* (2006.01)
*A63B 53/04* (2015.01)

(52) U.S. Cl.
CPC ..... *A63B 53/04* (2013.01); *A63B 2209/00* (2013.01); *A63B 2209/02* (2013.01); *A63B 2209/10* (2013.01)

(58) Field of Classification Search
CPC ..... A63B 53/04; B32B 37/02; B32B 38/08; B29C 65/14
USPC ..... 156/272.2, 273.3; 473/342, 324
See application file for complete search history.

(56) References Cited

U.S. PATENT DOCUMENTS

| | | | | |
|---|---|---|---|---|
| 4,613,403 | A | 9/1986 | Oyachi et al. | |
| 5,466,424 | A | 11/1995 | Kusano et al. | |
| 5,879,757 | A * | 3/1999 | Gutowski et al. | 427/491 |
| 6,315,915 | B1 | 11/2001 | Hebert et al. | |
| 6,869,645 | B2 | 3/2005 | Brum | |
| 2003/0145940 | A1 * | 8/2003 | Chaudhury et al. | 156/272.6 |
| 2005/0282655 | A1 * | 12/2005 | Sasaki | 473/324 |
| 2007/0173346 | A1 | 7/2007 | Chiang et al. | |
| 2009/0163291 | A1 * | 6/2009 | Chao | 473/342 |
| 2009/0226747 | A1 * | 9/2009 | Arber et al. | 428/480 |

* cited by examiner

*Primary Examiner* — Daniel McNally
(74) *Attorney, Agent, or Firm* — Klarquist Sparkman, LLP

(57) ABSTRACT

Described herein are methods for treating a surface of a first golf club head component with a plasma treatment prior to bonding a second golf club head component to the plasma-treated surface of the first golf club head component.

11 Claims, No Drawings

PLASMA TREATMENT OF GOLF CLUB COMPONENTS AND BONDING THEREOF

CROSS-REFERENCE TO RELATED APPLICATION

The present application claims the benefit of U.S. Provisional Application No. 61/426,995, filed Dec. 23, 2010, which is incorporated by reference herein in its entirety.

FIELD

This disclosure relates to methods for bonding golf club components and methods for plasma treating components prior to bonding.

BACKGROUND

When joining two or more components of a golf club head, it can be important to prepare the surfaces prior to mating. One method is to sandblast the components to increase surface area and therefore adhesion between components. Sandblasting roughens the surfaces, which can improve adhesion initially, but under cyclic loading (e.g., repeated golf ball impacts) can decrease the adhesive strength over time. During bonding or casting, air can be trapped in the pitting caused by the roughened surface. These air pockets offer no adhesion, tend to grow over time, and can eventually cause the joined components to separate.

SUMMARY

Described herein are embodiments of methods for bonding golf club components and methods for plasma treating the components prior to bonding.

For example, in some embodiments there is disclosed a method comprising:

treating a surface of a first golf club head component with a plasma treatment; and bonding a second golf club head component to the plasma-treated surface of the first golf club head component.

DETAILED DESCRIPTION

The inventive features and method acts include all novel and non-obvious features and method acts disclosed herein both alone and in novel and non-obvious sub-combinations with other elements and method acts. Unless specifically stated otherwise, processes and method acts described herein can be performed in any order and in any combination, including with other processes and/or method acts not specifically described. In this disclosure, it is to be understood that the terms "a", "an" and "at least one" encompass one or more of the specified elements. That is, if two of a particular element are present, one of these elements is also present and thus "an" element is present. The phrase "and/or" used between the last two of a list of elements means any one or more of the listed elements. For example, the phrase "A, B, and/or C" means "A," "B," "C," "A and B," "A and C," "B and C" or "A, B and C."

Golf club head components can be prepared prior to bonding by plasma treating the surface of one or more of the components. Plasma treatment can provide a cleaning of the surface of a component and electrochemically prepare the surface to bond with another surface. Unlike sandblasting, plasma treatment does not roughen the surface. Plasma treatment can leave a smooth surface such that air entrapment is reduced compared to sandblasting. Reduced air entrapment can allow the bonded surfaces to retain their adhesion longer, making the joint more durable.

Exemplary methods can comprise plasma treating a surface of a first golf club head component and bonding the treated surface to the surface of a second golf club head component. In some of these methods, a primer agent can be applied to the plasma treated surface and allowed to cure prior to bonding the treated surface to the surface of the second golf club head component. In some methods, the first component can comprise a carbon fiber epoxy face plate and the second component can comprise a polyurethane cover layer that is cast or molded onto the treated surface of the face plate. In some methods, the plasma treatment can comprise an air plasma treatment or a flame plasma treatment.

Plasma treatment increases the surface energy of the substrate being treated. In the case of polymers and polymer based composites, plasma surface activation can involve the replacement of surface polymer groups with chemical groups from the plasma. The plasma can break down weak surface bonds in the polymer and replace them with highly reactive carbonyl, carboxyl and hydroxyl groups. Such activation can reduce the surface tension of the treated surface and allow for improved wetting of the treated surface and acceptance of a bonding agent, such as a primer, yielding greatly enhanced adhesive strength and permanency.

Plasma treatment can cross-link surface polymers and produce a stronger and harder substrate microsurface. Crosslinking through plasma treatment can also lend additional wear resistance and chemical resistance to a substrate material.

Plasma treatment can also result in the formation of a thin polymer coating at the substrate surface through polymerization of the process gas. The deposited thin coating can possess various properties or physical characteristics, depending on the specific gas and process parameters selected. Such coatings can exhibit a higher degree of crosslinking and much stronger adherence to the substrate in comparison to films derived from conventional polymerization.

Plasma treatments can use a variety of process gasses, such as ambient air, argon, oxygen, hydrogen, nitrogen and ammonia, for example.

Plasma treatment can be used to improve bonding between various golf club head components, including but not limited to components that comprise a club head face. Plasma treatment can be used to help bond materials such as plastics, rubber, glass, metal and composites. In one embodiment, for example, an outer surface of a face plate can be plasma treated to improve the bond between the treated surface of the face plate and a polymer cover that is cast or molded onto the treated surface of the face. The face can be comprised of a carbon fiber epoxy composite, for example, and the polymer cover can be comprised of polyurethane or urethane, for example. The face plate can optionally also comprise a glass scrim layer.

After the outer surface of the face plate is plasma treated, a primer and/or other functional cross-linking agents can be applied to the treated surface. After the primer cures, the cover can be cast or molded onto the plasma treated and primed surface of the face plate. In some embodiments, after the primer has cured, the primed surface can be plasma treated again prior to bonding with the cover. The polymeric cover can also be plasma treated prior to bonding.

Plasma treatment can also be used to improve bonding between a composite/polymeric component and a metal component. In such case, the metal surface, the composite/polymeric surface, or both, can be plasma treated prior to bonding.

There are several types of plasma treatments that can be used to improve bonding of golf club head components. Examples include air plasma treatment and flame plasma treatment. Air plasma, or atmospheric plasma, treatments can use ambient air at atmospheric pressure. In an exemplary air plasma treatment, the treatment surface can be bombarded with highly energized molecules and ions. The positive molecules and ions can rapidly microclean the surface, removing organic and inorganic contaminants. At the same time, the air plasma can highly activate the surface, creating new functional groups for reliable adhesion or bonding. The surface being treated can be exposed to the air plasma for short intervals, such as the exposure occurring as a golf club head component rests on a belt positioned in proximity to a source of air plasma and traveling at about 5 to about 15 feet per minute. The air plasma treatment can produce a durable, uniform surface adhesion. Air plasma treatment can be performed, for example, using a Plasmadyne™ in air plasma treatment system from 3DT, LLC.

Flame plasma treatments can combine a fuel such as propane or liquefied natural gas and an oxygen source, such as atmospheric air, to create an intense flame. Brief exposure to the energized particle within the flame can affect the distribution and density of electrons on the substrate's surface and polarize surface molecules through oxidation. The flame plasma treatment can also deposit other functional chemical groups that further promote wetting and adhesion. Flame plasma treatment can also decontaminate and polish the surface prior to bonding. The surface being treated can be exposed to the flame plasma for short intervals, such as the exposure occurring as a golf club head component rests on a belt positioned in proximity to a source of flame plasma and traveling at about 5 to about 100 feet per minute. The flame plasma treatment can produce a durable, uniform surface adhesion. Flame plasma treatment can be performed, for example, using a Dyne-A-Flame™ three-dimensional flame plasma treater from Enercon Industries, Corp.

In some instances, plasma treatment can be performed within a vacuum chamber. For example, the component to be treated can be placed in a sealed chamber and the chamber can be evacuated by a pump while a process gas, such as ambient air, is admitted into the chamber. The pressure within the chamber can be about 260 Torr, for example. The gases can then be subjected to induced RF magnetic and electric fields, which generate plasma through RF/collisional heating of electrons within the process gas. Overall temperature changes within the chamber can be minimal. Exposure times for this type of vacuum plasma treatment can be from about 5 seconds to about 10 minutes after formation of the plasma. Vacuum plasma treatment can be performed, for example, using a PDC-001 Plasma Cleaner from Harrick Plasma.

Plasma treatments can be superior to other surface treatment methods for several reasons. Plasma treatment can clean or decontaminate a surface at an atomic level, resulting in an "atomically clean" surface. Plasma has no surface tension constraints, unlike aqueous cleaning solutions, and can treat rough, porous and uneven surfaces. Plasma treatment can occur at or near ambient temperature, minimizing risk of damage to heat-sensitive materials. Plasma treatment can both activate and clean at the same time. Plasma treatment can be used to treat unusually shaped components with difficult geometries. Plasma treatment can be highly reproducible and more consistent than chemical or mechanical processes. Plasma treatment times can be very short, with no drying or curing time and little energy consumed. Plasma treatment does not produce VOCs or other harmful chemicals. Plasma treatment can be safer than chemical or mechanical treatments. Most plasma processes are classified as "green" environmentally friendly processes by the EPA.

Peel Test

This section describes an exemplary method, referred to as the "peel test," for measuring bond strengths between a golf club face plate and a cover layer bonded to the face plate. The peel test includes the following steps.

First, two parallel cuts 1" apart are made in the cover layer. The portion of the cover layer between the cuts forms a 1" wide strip extending across the face plate. The cover layer strip extends horizontally from heel to toe across the center of the face plate. Each end of the strip is covered with a non-adhesive release tape such that the covered ends of the strip are not bonded to the face plate and are free to be gripped by jaws of a tensile tester machine. The face plate is then affixed to a mounting table. The mounting table prevents the face plate from moving vertically, but is capable of sliding horizontally such that the area being peeled is directly underneath the gripping jaws throughout the peel test. The face plate is mounted such that the 1" wide strip is roughly parallel to the horizontal motion of the sliding mounting table (although the face plate and cover layer are actually slightly convex). One of the free covered edges of the 1" wide cover layer strip is then inserted into and gripped by the clamping jaws of the tensile tester. The tensile tester is then zeroed and the peel test begins. The tensile tester pulls the free end of the strip upward at a rate of 0.5 mm per second, slowly peeling the strip apart from the face plate. As the tensile tester pulls the strip vertically, the mounting table simultaneously slides horizontally such that the area being peeled is directly beneath the clamping jaws and the peel force is perpendicular to the bond interface between the strip and face plate. The peel test is performed until at least 20 mm of the strip have been peeled away from the face plate. The amount of force (N) exerted by the tensile tester is recorded throughout the peel test as a function of the peel displacement (mm). From this data, a peak force required to initiate the peeling is recorded, and the minimum steady state peel force required to complete the 20 mm peel displacement is recorded. For each face plate and cover layer strip specimen that is tested, the cover layer strip is peel tested from both sides of the strip and two sets of data are recorded. Each specimen tested can comprise a different combination of materials, pre-bonding treatments, and/or post-bonding treatments.

Prior to bonding the cover layer to the face plate, the face plate can be pretreated with one or more methods. For example, the face plate can be cleaned using soap and water prior to bonding. As another example, the face plate can be mechanically abraded, such as by abrading using a conventional 3M® Scotch Brite™ belt or wheel (or other comparable mechanical mechanism) across the surface. As another example, the face plate can be cleaned using acetone. As another example, the face plate can be treated with a plasma treatment, as described herein. As yet another example, the face plate can be treated with a primer agent, as described herein. Typically, some combination of these exemplary methods is used to pre-treat the face plate prior to bonding with the cover layer. In some methods, one or more of these treatments can be performed more than once.

After the pretreatment process, the face plate can be placed in a mold containing a polymeric material that bonds to the face plate and forms the cover layer. To facilitate removing the face plate/cover layer combination from the mold, the mold can comprise a mold release material, such a coating, on the inner surface.

After the bonding process, the face plate/cover layer combination can optionally also be subjected to durability simulations prior to the peel test. Durability simulations can include subjecting the face plate to repeated impacts from a golf ball, for example.

Peel Test Data

Table 1 below includes test data recorded using the peel test described above for various face plate/cover layer specimens that were pretreated with different combinations of the methods described above.

TABLE 1

| Spec. | Prep 1 | Prep 2 | Min Load 1 | Min Load 2 | Average |
|---|---|---|---|---|---|
| 1 | Soap & Prime | Acetone Clean | 45.1 | 43.0 | |
| 2 | Soap & Prime | Acetone Clean | 14.4 | 15.8 | 29.6 |
| 3 | Soap & Prime | Acetone & Plasma | 81.8 | 92.5 | |
| 4 | Soap & Prime | Acetone & Plasma | 65.2 | 63.1 | 75.7 |
| 5 | Soap & Prime | 3M & Plasma | 68.3 | 71.0 | |
| 6 | Soap & Prime | 3M & Plasma | 82.5 | 80.2 | 75.5 |
| 7 | Soap & Prime | Acetone & 3M & Plasma | 76.6 | 77.5 | |
| 8 | Soap & Prime | Acetone & 3M & Plasma | 82.0 | 75.0 | 77.8 |
| 9 | Soap & Prime | Plasma | 69.3 | 61.3 | |
| 10 | Soap & Prime | Plasma | 55.4 | 46.9 | 58.2 |
| 11 | Soap & Prime | 3M | 45.0 | 57.9 | |
| 12 | Soap & Prime | 3M | 69.6 | 79.8 | 63.1 |
| 13 | Soap & Prime | Acetone Clean | 0.0 | 0.0 | |
| 14 | Soap & Prime | Acetone Clean | 0.0 | 0.2 | 0.1 |
| 15 | Soap & Prime | Acetone & Plasma | 51.3 | 39.5 | |
| 16 | Soap & Prime | Acetone & Plasma | 40.5 | 37 | 43.8 |
| 17 | Soap & Prime | 3M & Plasma | 69.6 | 20.0 | |
| 18 | Soap & Prime | 3M & Plasma | 64.7 | 22.0 | 44.1 |
| 19 | Soap & Prime | Acetone & 3M & Plasma | 40.0 | 75.0 | |
| 20 | Soap & Prime | Acetone & 3M & Plasma | 75.0 | 59.8 | 62.5 |
| 21 | Soap Wash Only | | 0.0 | 0.0 | |

The upper section of Table 1 (specimens 1-12) lists test data for face plate/cover layer combinations formed using a PTFE mold release material, and the lower section (specimens 13-21) lists data from tests using a wax mold release material. For all of the specimens tested that are listed in Table 1, the face plate was first cleaned with soap and water and was treated with a primer agent just prior to bonding with the cover layer, as shown in the "Prep 1" column.

The "Prep 2" column lists the other pretreatments that were applied to the face plate. The plasma treatment used for these tests was a vacuum chamber type plasma treatment, as described above, using a PDC-001 Plasma Cleaner from Harrick Plasma. Each of the treatments listed in the "Prep 2" column were performed in the order listed, with the soap wash be performed beforehand and the primer being applied afterward.

The "Min Load 1" column represents the minimum steady state load in Newtons per inch recorded over 20 cm of peeling from one side of a specimen and the "Min Load 2" column represents the same for the other side of the same specimen. Two specimens were tested for each combination of the pretreatments. The average of the four minimum steady state load values for each combination of pretreatments in listed in the "Average" column. The term "minimum steady state peel strength" means this average value of the four minimum steady state load values.

Table 2 below lists minimum and maximum peel strengths in Newtons per inch recorded for various specimens after the specimens were subjected to repeated golf ball impacts during a durability simulation. The "Durability" column describes the type bond failure occurring between the cover layer and face plate after the durability testing. All of the specimens listed in Table 2 were pretreated with soap wash, vacuum chamber plasma treatment using a PDC-001 Plasma Cleaner from Harrick Plasma, and a primer agent. Note that no specimen tested that showed any delamination failure had a minimum steady state peel strength of at least 36 Newtons per inch.

TABLE 2

| Specimen | Min Load | Max Load | Durability |
|---|---|---|---|
| A | 6.0 | 50.6 | No Delaminations |
| B | 24.7 | 51.1 | No Delaminations |
| C | 38.2 | 60.9 | No Delaminations |
| D | 37.2 | 60.1 | No Delaminations |
| E | 20.7 | 51.5 | No Delaminations |
| F | 29.1 | 55.0 | No Delaminations |
| G | 38.0 | 58.5 | No Delaminations |
| H | 8.1 | 33.8 | Slight Pin Size Delaminations |
| I | 35.7 | 67.3 | Slight Pin Size Delaminations |
| J | 25.3 | 40.0 | Slight Pin Size Delaminations |
| K | 12.2 | 52.0 | Multiple Small Delaminations |
| L | 3.9 | 26.9 | Multiple Small Delaminations |
| M | 10.3 | 40.9 | Multiple Small Delaminations |
| N | 30.0 | 50.7 | Multiple Small Delaminations |
| O | 10.9 | 46.1 | Multiple Small Delaminations |
| P | 11.4 | 42.5 | Fail |

In view of the many possible embodiments to which the principles disclosed herein may be applied, it should be recognized that the illustrated embodiments are only examples and should not be taken as limiting the scope of the invention.

We claim:

1. A method comprising:

treating a surface of a first golf club head component with a first plasma treatment;

treating the plasma-treated surface with a primer agent;

treating the surface with a second plasma treatment after treating the surface with the primer agent; and bonding a second golf club head component to the surface of the first golf club head component after treating the surface with the first plasma treatment, the primer agent, and the second plasma treatment, wherein the second golf club head component is a polymer cover layer.

2. The method of claim 1, wherein the first golf club head component comprises a carbon fiber epoxy face plate and the surface comprises an outer striking surface of the face plate.

3. The method of claim 2, wherein the second golf club component comprises a polyurethane or urethane cover layer.

4. The method of claim 3, wherein the bonding comprises molding the cover layer to the outer striking surface of the face plate.

5. The method of claim 1, wherein at least one of the first plasma treatment and the second plasma treatment is a flame plasma treatment.

6. The method of claim 1, wherein at least one of the first plasma treatment and the second plasma treatment is an air plasma treatment.

7. The method of claim 1, wherein at least one of the first plasma treatment and the second plasma treatment comprises:

placing the first golf club head component in a sealed chamber;

removing atmospheric air from the chamber and admitting a process gas into the chamber such that a partial vacuum exists within the chamber; and subjecting the process gas to induced RF magnetic and electric fields such that plasma is generated from the process gas.

8. The method of claim 1, wherein after bonding, the bond between first and second components has an average minimum peel strength of at least 58 Newtons per inch.

9. The method of claim 1, wherein after bonding, the bond between first and second components has an average minimum peel strength of at least 75 Newtons per inch.

10. The method of claim 1, further comprising treating a surface of the second golf club head component with a plasma treatment prior to bonding the second surface to the first surface.

11. The method of claim 1, wherein after bonding, the bond between first and second components has an average minimum peel strength of at least 40 Newtons per inch.

* * * * *